United States Patent [19]

Kameya et al.

[11] Patent Number: 4,758,807

[45] Date of Patent: Jul. 19, 1988

[54] DISTRIBUTED CONSTANT TYPE ELECTROMAGNETIC DELAY LINE

[75] Inventors: Kazuo Kameya, Tsurugashima; Tsuyoshi Suaa, Kawagoe, both of Japan

[73] Assignee: Elmec Corporation, Saitama, Japan

[21] Appl. No.: 809,713

[22] Filed: Dec. 17, 1985

[30] Foreign Application Priority Data

Dec. 18, 1984 [JP] Japan ..... 59-191905[U]
Dec. 19, 1984 [JP] Japan ..... 59-192758[U]

[51] Int. Cl.[4] ..... H01P 9/00
[52] U.S. Cl. ..... 333/156; 333/162
[58] Field of Search ..... 333/140, 156, 161, 162, 333/23, 245; 336/200, 223; 29/600, 602 R

[56] References Cited

U.S. PATENT DOCUMENTS 4,507,628 3/1985 Kameya ..... 333/138
4,525,691 6/1985 Kameya ..... 333/139
4,546,332 10/1985 Kameya ..... 333/139
4,570,136 2/1986 Kameya ..... 333/156 X

FOREIGN PATENT DOCUMENTS 0110009 8/1980 Japan ..... 336/200
0101513 6/1983 Japan ..... 333/156

*Primary Examiner*—Eugene R. LaRoche
*Assistant Examiner*—Seung Ham
*Attorney, Agent, or Firm*—Wegner & Bretschneider

[57] ABSTRACT

This distributed constant type electromagnetic delay line has an elongated bobbin which includes, laminated together, a substantially rectangular dielectric layer and a substantially rectangular ground plane, and further includes an electroconductive strip, constituted by a single layer solenoid fixedly secured to the bobbin by its outer surface. As a variation, this distributed constant type electromagnetic delay line may have an elongated bobbin which includes, laminated together: a first substantially rectangular dielectric layer; a second substantially rectangular dielectric layer; and a substantially rectangular ground plane sandwiched between the first and second dielectric layers; and may further include an electroconductive strip, constituted by a single layer solenoid fixedly secured to the bobbin and wound in a spaced manner around the outer surface of the bobbin confronting the ground plane.

19 Claims, 6 Drawing Sheets

DISTRIBUTED CONSTANT TYPE ELECTROMAGNETIC DELAY LINE

BACKGROUND OF THE INVENTION

The present invention relates to a distributed constant type electromagnetic delay line for handling a super high speed signal having a rise time which is equal to or less than one nanosecond, and in particular relates to an improvement of such a distributed constant type electromagnetic delay line in which an electroconductive strip and a ground plane oppose each other with a dielectric layer interposed therebetween.

A type of delay line is shown in FIGS. 17 and 18 of the accompanying drawings in front view and in side on view respectively. This delay line, which it is not intended hereby to admit as prior art to the present application except to the extent otherwise required by applicable law, and which was developed in the workshops of the assignee of the present application by an inventive entity under obligation to assign any intellectual property rights arising therefrom to the assignee of the present application, has a flattened and elongated bobbin 5 which is formed by covering the outer circumference of a ground plane 1 formed in the shape of a plate strip with dielectric material 3, and an electroconductive strip 7 is formed by winding a single layered solenoid in a spaced manner around the outer circumference of the bobbin 5 so that this electroconductive strip 7 opposes the ground plane 1. The electroconductive strip 7 in the drawings makes use of a plurality of individual electroconductive strips 9 which are in the shape of fine strips, and these are connected in series so as to form a single solenoid layer.

Such an electromagnetic delay line can produce favorable delay properties with respect to super high speed signals, and it is suitable for compact design, but according to studies performed by the present inventive entity it has been discovered that there remains further room for improvement.

Specifically, since the bobbin 5 in the above outlined construction is made by covering the outer circumference of the ground plane 1 with the dielectric material 3 having a constant thickness, it is necessary to use a special metallic die for forming the bobbin 5.

However, in general there are required a variety of electromagnetic delay lines with various delay times and impedance properties, and therefore, in order to make an electromagnetic delay line having desired properties, it is necessary to change the width W and the thickness T of the bobbin 5.

However, when the dimensions of the bobbin 5 are changed, the metallic die for forming it is naturally required to be changed, and this entails a need for stocking a large number of metallic dies, which in turn increases the necessary investment required, and makes the production process more complex. Further, in making actual electromagnetic delay lines, the forming of electroconductive strips 7 on such a variety of bobbins 5 requires various production expedients and ingenuities.

SUMMARY OF THE INVENTION

This invention has been made in view of such circumstances.

Accordingly, it is the primary object of the present invention to provide a distributed constant type electromagnetic delay line which is easy to manufacture and is economical.

It is a further object of the present invention to provide such a distributed constant type electromagnetic delay line, according to which the manufacture of the bobbin is simple and does not require a metallic die mold.

It is a further object of the present invention to provide such a distributed constant type electromagnetic delay line, according to which various operational properties can be obtained in a simple manner.

It is a yet further object of the present invention to provide such a distributed constant type electromagnetic delay line, according to which stable properties can be obtained, even when the line is being mass produced.

It is a yet further object of the present invention to provide such a distributed constant type electromagnetic delay line, which is favorable in various properties, in particular in the rise properties of the output signal and the amplitude properties with respect to frequency.

According to the most general aspect of the present invention, these and other objects are accomplished by a distributed constant type electromagnetic delay line comprising: (a) an elongated bobbin comprising, laminated together: (a1) a first substantially rectangular dielectric layer; (a2) a second substantially rectangular dielectric layer; and (a3) a substantially rectangular ground plane sandwiched between said first and second dielectric layers; and: (b) an electroconductive strip, constituted by a single layer solenoid fixedly secured to the bobbin and wound in a spaced manner around the outer surface of the bobbin confronting the ground plane; or, alternatively, by a distributed constant type electromagnetic delay line comprising:

(a) an elongated bobbin comprising, laminated together:

(a1) a substantially rectangular dielectric layer; and (a2) a substantially rectangular ground plane; and:

(b) an electroconductive strip, constituted by a single layer solenoid fixedly secured to the bobbin by its outer surface.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are to be everywhere understood in terms of the relevant figure; and:

DESCRIPTION OF THE PREFERRED EMBODIMENTS

Figure 1:
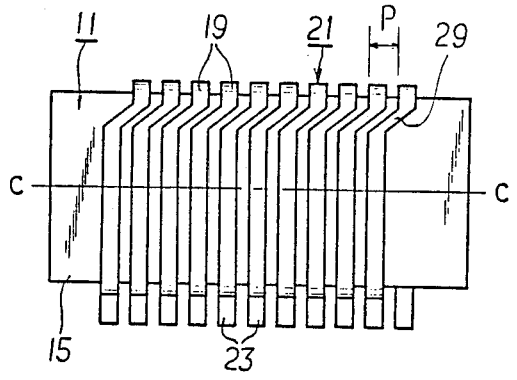
FIGS. 1 and 2 are respectively a front view and a side view showing a first preferred embodiment of the distributed constant type electromagnetic delay line according to this invention.
Figure 2:
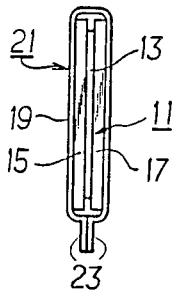
Figure 3:
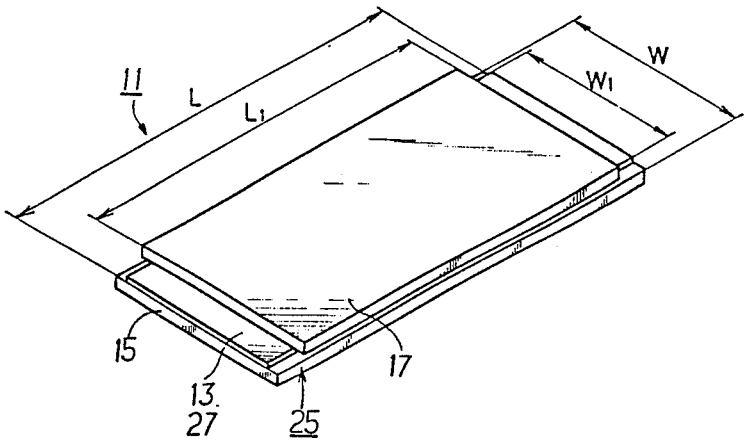
FIG. 3 is a perspective view showing the bobbin of the line of FIG. 1.

The present invention will now be described with reference to the preferred embodiments thereof, and with reference to the appended drawings. FIGS. 1 and 2 show a first preferred embodiment of the distributed constant type electromagnetic delay line of this invention, in front view and side on view respectively, and FIG. 3 shows the same in perspective view.

An elongated and flattened bobbin 11 is made in the following way. A first dielectric plate 15 which is made of fluoride resin and is rectangular in shape, having a length L and a width W, is adhered on one of the major surfaces (the lower surface in FIG. 3) of a rectangular ground plane 13 having a width $W_1$ and a length substantially equal to L; the width W of the dielectric plate 15 is greater than the width $W_1$ of the ground plane 13. And a second dielectric plate 17 which is also made of fluoride resin and is rectangular in shape, having a width substantially equal to W and a length L1 which is shorter than the length L of the ground plane 13, is adhered on the other major surface (the upper surface in FIG. 3) of the ground plane 13. Since the length L1 of the second dielectric plate 17 is shorter than the length L of the first dielectric plate 15, the ground plane 13 is exposed at both its lengthwise ends. In FIG. 1, the exposed portions of the ground plane 13 are not shown.

An electroconductive strip 21 is formed on the outer circumference of the bobbin 11 by winding a single layered solenoid around it at a certain pitch P. This electroconductive strip 21 is formed as follows. Specifically, a plurality of strip shaped unit electroconductive strips 19, which are slightly longer than the winding length of one pitch and are provided with bends 29 at their middle portions so that their ends 23 are offset from one another by one pitch P, after each being bent into a C shape, are each adhered to the bobbin 11 so as to cross the lengthwise direction C—C of the bobbin 11, and the ends 23 of the neighboring individual electroconductive strips 19 are thus made to project sideways from the bobbin 11 and are laid over on one another so as conveniently to be soldered together, thus connecting the individual electroconductive strips 19 in series.

Since, according to this electromagnetic delay line, the bobbin 11 is formed by laminating together the plate shaped ground plane 13 and the first and the second dielectric plates 15, 17, it is possible to form in a simple and convenient fashion a bobbin 11 of an arbitrary shape, just by changing the dimensions of the first and the second dielectric plates 15, 17 and the ground plane 13, thereby eliminating the need to prepare a number of different metallic dies for mold forming various different bobbins.

Furthermore, fluoride resin plates of various thicknesses are commercially available, and when such plates are used as the first and the second dielectric plates 15, 17, it is possible to form bobbins 11 having various dimensions and shapes suitable for desired delay times and characteristic impedance without any difficulty in procurement or working.

Now, an example of the method of making such an electromagnetic delay line is described in the following.

With reference to FIG. 3, considering a particular example, a laminated board 25 plated with copper on one side and made of fluoride resin for providing the insulating plate is cut into a piece of width W, and the conducting portion 27 consisting of the copper plated portion is formed into a width $W_1$ which is smaller than the width W by photoetching to make it into a ground plane 13; and both are cut to the length L. The insulating plate of the laminating base board 25 thus functions as the first dielectric plate 15.

Thereafter, a second dielectric plate 17 made of fluoride resin and formed with width W and length L1 is pressed upon the laminating base board 25, applying heat at the same time, with the ground plane 13 interposed therebetween, so as to form the bobbin 11. During this process, the second dielectric plate 17 is laid over the ground plane 13 so that the lengthwise ends of the ground plane 13 are exposed. Thus, the FIG. 3 assembly is produced.

Figure 4:
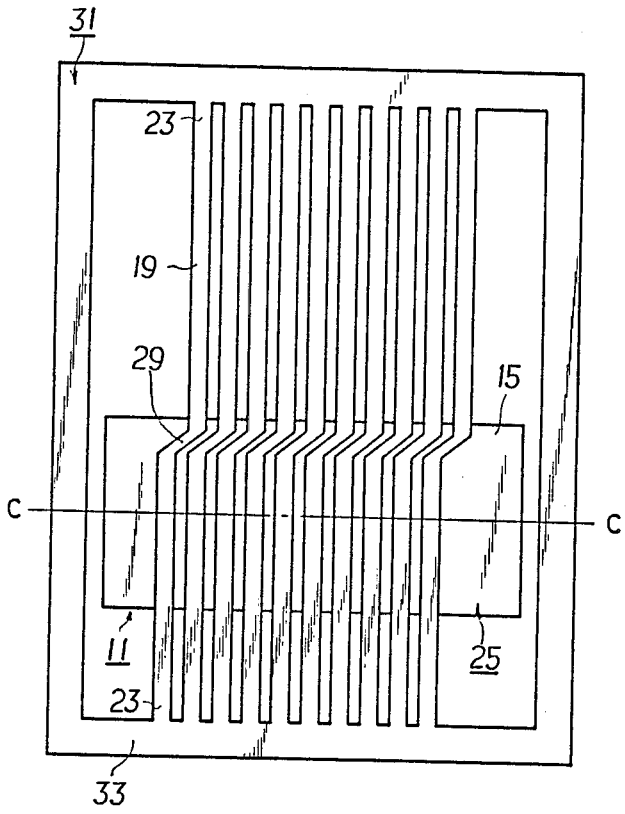
FIGS. 4 and 5 are respectively a front view and a side view illustrating the process of making the distributed constant type electromagnetic delay line of FIG. 1.
Figure 5:
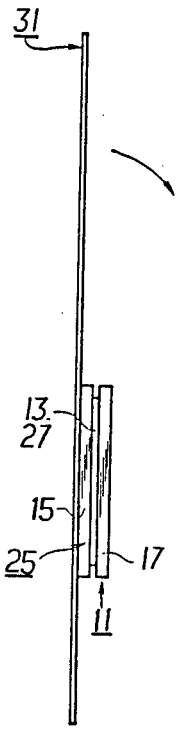

Then, as shown in FIGS. 4 and 5, an electroconductive frame 31 is prepared which is made by interconnecting a plurality of strip shaped individual electroconductive strips 19, in a parallel relationship, having the bends 29 in their middle portions, in such a manner that their ends 23 are offset from each other by one pitch. This electroconductive frame 31 is formed from an electroconductive plate, for instance by photo etching.

Then, halves of the individual electroconductive strips 19 are pressed against one of the surfaces of the bobbin 11, for instance against the first dielectric plate 15, by applying a jig thereto, and these members are thermally pressed against one another at a temperature in excess of 300° C. Thereafter, the individual electroconductive strips 19 are bent into the C shape and the other halves of the individual electroconductive strips 19 are likewise thermally adhered to the opposite surface of the bobbin 11, i.e. to the second dielectric plate 17, so that the ends 23 of the neighboring individual electroconductive strips 19 may be laid over and fixed to each other. Thereafter, the ends 23 of the individual electroconductive strips 19 are connected together, each to the next, by soldering, and the unnecessary portions and the frame portion 33 of the individual electroconductive strips 19 are cut off, to complete the electromagnetic delay line shown in FIG. 1.

Thus, also, when making an electromagnetic delay line by using the laminated board 25, since the insulating plates are commercially available in various thicknesses, the process is economical. However, it goes without saying that, as an alternative, without using the laminated board 25, the bobbin 11 may be made by laminating together an individual ground plane 13 and a first and a second dielectric plate 15, 17.

Figure 6:
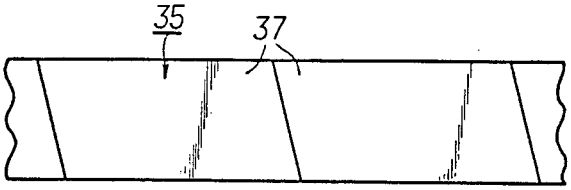
FIGS. 6 and 7 are plan views showing modifications of said first preferred embodiment of the bobbin of the distributed constant type electromagnetic delay line according to this invention.
Figure 7:
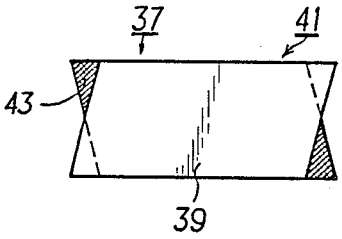

FIGS. 6 and 7 show a variation of the bobbin for use in the electromagnetic delay line of this invention. Specifically, a laminated board material 35 is prepared which has an elongated strip shaped electroconductive portion on one of its sides, and a parallelopipedal laminated board 37 is prepared by cutting it in an oblique manner at a certain interval. Likewise, a second dielectric plate 39 of a parallelopipedal shape is formed by cutting an elongated strip of fluoride resin plate (not shown in the drawing) in a likewise oblique manner at a certain interval, and a bobbin 41 is formed by laminating the laminated board 37 and the second dielectric plate 39 in an inverted relationship so that their lengthwise ends will not overlay each other.

According to the bobbin 41 of such a structure, the electroconductive portion 43 serving as a ground plane is partially exposed without reducing the lengthwise dimension of the second dielectric plate 39, and the connection to the external circuit is simplified.

However, it is not necessary to form the laminated board 37 or the second dielectric plate 39 by cutting them obliquely, but it is also possible to shift the mutually overlaying positions of the laminated board 37 and the second dielectric plate 39 or, alternatively, the electroconductive portion 43 may be partially exposed, if they are cut in a curved manner, and the end portions of the laminated board 37 and the second dielectric plate 39 are offset from each other.

And, in the above described preferred embodiment, if the width $W_1$ of the ground plane and the widths of the first and the second dielectric plates 15 and 17 of FIG. 3 are made equal, the processing of the electroconductive portion 27 may be eliminated in the production process using the laminated board 25 and the manufacturing cost may be reduced.

In this case, one might anticipate short circuiting of the electroconductive strip 21 and the ground plane 13 along the lengthwise side surface of the bobbin 11, but, since the electroconductive strip 21 curves, in an outwardly bulging manner, on the side surface of the bobbin 11, as shown in FIG. 2, there will be no short circuiting between the ground plane 13 and the electroconductive strip 21. And, if insulating paint is coated over the lengthwise side surfaces of the bobbin 11, the prevention of such short circuiting between the electroconductive strip 21 and the ground plane 13 can be assured.

Now, a second preferred embodiment of this invention will be described. In the above described first preferred embodiment, the electroconductive strip 21 was adhered to the two surfaces of the first and the second dielectric plates 15 and 17 forming the bobbin 11, but, in the second preferred embodiment, the electroconductive strip 21 is fixedly secured to one of the surfaces of the bobbin. Since the front view of the electromagnetic delay line is similar to that shown in FIG. 1 and the bobbin 45 is similar to that shown in FIG. 3, illustration thereof is omitted herein.

Figure 8:
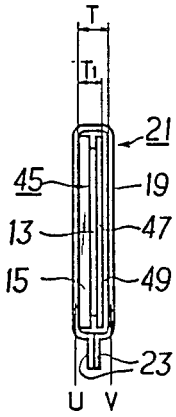
FIG. 8 is a side view showing a second preferred embodiment of this invention.

Specifically, as shown in FIG. 8, in this elongated and flattened bobbin 45, a second dielectric plate 47 is thinner than a first dielectric plate 15, and individual electroconductive strips 19 are fixedly adhered to the first dielectric plate 15 inside an electroconductive strip 21.

In other words, the electroconductive strip 21 is wound, in a spaced manner, into a single layer solenoid by being bent back alternatingly between a first imaginary surface U and a second imaginary surface V, and the individual electroconductive strips 19 are fixedly secured to the bobbin 45 on the first imaginary surface U, while a gap 49 is defined between the individual electroconductive strips 19 and the second dielectric plate 47 on the second imaginary plane V. In FIG. 8, the symbol $T_1$ denotes the thickness of the bobbin 45, and the symbol T denotes the internal dimension between the individual electroconductive strips 19 which oppose each other with the bobbin 45 interposed therebetween.

In the same manner as in the second preferred embodiment, it is possible to consider the electroconductive strip 21 of the first preferred embodiment to be formed by being alternatingly bent back between the first and the second imaginary planes U and V. And these first and second imaginary surfaces U and V need not be limited to being precise planes.

According to an electromagnetic delay line of this structure, by appropriately selecting the thickness of the electroconductive strip 21, the electroconductive strip 21 is not easily deformed by external forces and keeps its dimension T even if the electroconductive strip 21 were not fixedly secured to one of the major surfaces of the bobbin 45. There is a possibility that the thickness $T_1$ of the bobbin 45 should be slightly different from the dimension T of the space between the individual electroconductive strips 19, and the electrostatic capacitance between the ground plane 13 and an individual electroconductive strip 19 may vary as it is developed across the first dielectric plate 15 and the second dielectric plate 47. However, if the dimensions T and $T_1$ are determined by taking into consideration the differences in the capacitances when designing the electromagnetic delay line, it is possible to easily obtain the desired properties.

If material of low dielectric constant such as fluoride resin is used for the first and the second dielectric plates 15 and 47, even when the dielectric layer between one of the imaginary planes of the electroconductive strip 21 and the ground plane 13 comprises a second dielectric plate 47 and an air gap 49, which has the dielectric constant of 1, it is possible to make the electric properties of the electromagnetic delay line favorable, and to reduce their fluctuations.

Figure 9:
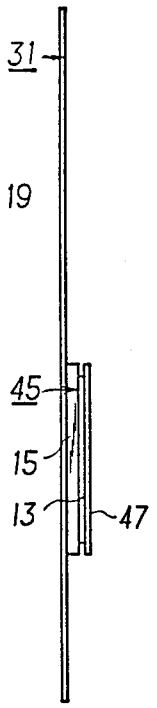
FIG. 9 is a side view showing an example of a process of making the electromagnetic delay line of FIG. 8.

In this electromagnetic delay line, also, as shown in FIG. 9, in the same way as in the first preferred embodiment, part of the individual electroconductive strips 19 are overlaid on one of the surfaces of the bobbin 45 or on the first dielectric plate 15, to be thermally adhered, and, after the individual electroconductive strips 19 are bent back so as to lay over the opposite surface of the bobbin 45, the ends 23 of the individual electroconductive strips 19 are soldered together in a series connection, to complete this electromagnetic delay line.

Figure 10:
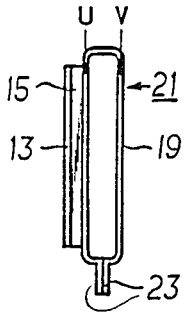
FIG. 10 is a side view showing a modification of said second preferred embodiment of the electromagnetic delay line of FIG. 8.

The structure for securely adhering the electroconductive strip to one of the surfaces of the bobbin is not limited to the example in which the bobbin is arranged on the internal side of the electroconductive strip, but it is also possible, as shown in FIG. 10, to fixedly adhere the first dielectric plate 15 on the side of the first imaginary plane U on the outside of the electroconductive strip 21. In this case, the second dielectric plate 17 can be eliminated or omitted. Of course, it is possible to adhere fixedly to the side of the second imaginary plane V, and in this case the first dielectric plate 15 may be omitted.

Now, the third preferred embodiment will be described.

Figure 11:
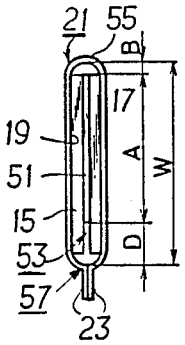
FIG. 11 is a side view showing a third preferred embodiment of this invention.

The structure of this electromagnetic delay line is substantially identical to that of the first preferred embodiment, but, as shown in FIG. 11, the ground plane 51, which is interposed between the first and second dielectric plates 15 and 17, is arranged away from one side of the bobbin 53 along its widthwise direction, or in other words away from the ends 23 of the individual electroconductive strips 19 (to the top side of the drawings), or, in yet other words, nearer to the side of the bends 55 of the individual electroconductive strips 19. Therefore, according to this bobbin 55, the distance B between one end (the top end in the drawing) of the ground plane 51 and the inner side of the bends 55 is smaller than the distance D between the other end of the ground plane 51 (the lower end in the drawing) and the overlaid portion 57 of the ends 23 of the individual electroconductive strips 19, and each of the individual electroconductive strips 19 does not oppose the ground plane 51 before and after the overlaid portion 57.

Figure 12:
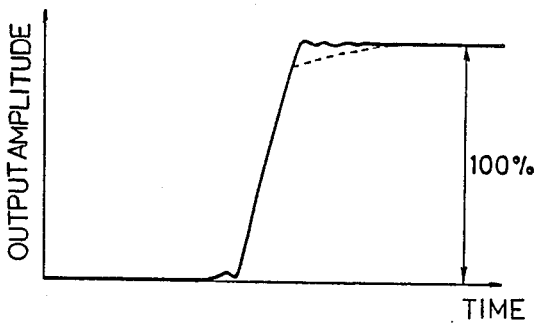
FIG. 12 is a property diagram of the electromagnetic delay line of FIG. 11.

Thus, by shifting the ground plane 51 towards the side of the bends 55 of the individual electroconductive strip 19 and preventing a portion of the individual electroconductive strips 19 from opposing the ground plane 51, the output pulse signal can briskly rise at a certain slope to the 100% value of the output amplitude, as shown by the solid line in FIG. 12.

The reason for such a result may be considered as follows. Since the electroconductive strip 21 has a portion in each of its turns where it does not oppose the ground plane 51, the electromagnetic delay line may be expressed by the equivalent circuit of FIG. 13. According to this circuit, the electromagnetic delay line comprises a microstrip line DL which has a certain capacitance relative to the ground plane 51 at each turn, and an inductance L, connected in series thereto, which does not oppose the ground plane 51 and has almost no capacitance relative to the ground plane 51.

Each of the individual electroconductive strips 19 forms mutual inductances M1, M2, . . . Mn in relation with the neighboring individual electroconductive strip 19, the next individual electroconductive strip, . . . the nth neighboring individual electroconductive strip 19, and since the portion of the microstrip line DL is greater than the portion of the inductance L at each turn it is possible to conceive that the mutual inductances are formed between the microstrip lines DL, whereby the inductance L may be disregarded. However, if the portions of the inductance L are great, they may be considered as being included in the microstrip lines DL.

Figure 13:
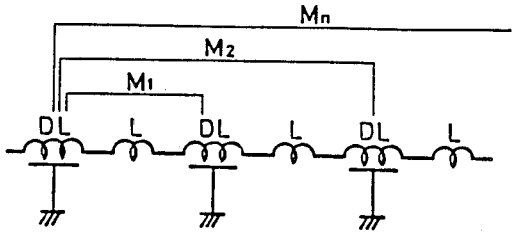
FIG. 13 is a equivalent circuit diagram of the electromagnetic delay line of FIG. 11.

In FIG. 13, the mutual inductances are denoted with respect to the leftmost microstrip line DL in relation with the microstrip lines DL located to the right thereof, but the microstrip lines located to the left thereof also form mutual inductances. As a matter of fact, each of the microstrip lines DL forms mutual inductances with the microstrip lines located to the right and to the left thereof.

Figure 14:
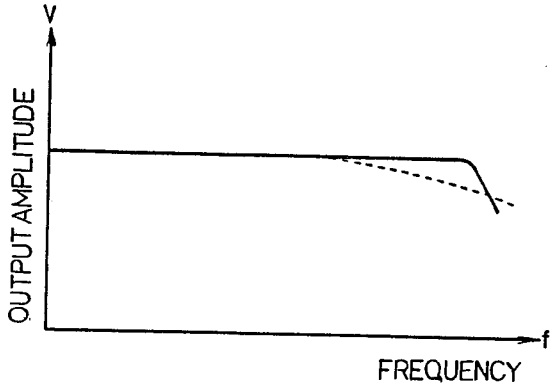
FIG. 14 is another property diagram of the electromagnetic delay line of FIG. 11.

Another aspect of the electric properties of the electromagnetic delay line, in regards to the third preferred embodiment, is shown in FIG. 14.

In the case of an electromagnetic delay line having no inductance L, the output amplitude V declines gradually with the increase in the frequency f, as shown as an example by the broken line in FIG. 14. On the other hand, in the case of an electromagnetic delay line including the inductance L, the output amplitude V is flat up to a certain frequency, and tends to rapidly decline beyond that particular frequency.

As far as cut off frequency is concerned, the property shown by the broken line has a higher cut off frequency, but the cut off frequency is not required to be higher than the pass band which is required from the rise time of the input pulse signals. Rather, the wave form of the output pulse signal becomes more favorable if the amplitude property is flat within the region which the rise time of the input pulse signal requires.

Therefore, if the cut off frequency is within the range required by the pulse rise time of the input pulse signal, it is possible to improve the wave form of the rise of the output pulse signal by forming the electroconductive strip 21 from both the microstrip line DL portion and the inductance L portion.

According to the electromagnetic delay line of this preferred embodiment, the properties are expected to change considerably, depending upon the values of the dimensions B and D in relation with the width W of the bobbin 53, and therefore the present inventors formed an electroconductor of 0.07 mm and a width of 0.2 mm in the form of a single layer solenoid of 40 turns at the pitch of 0.35 mm on a bobbin 53 having a width of 5 mm, and prepared a distributed constant type electromagnetic delay line having a delay time of two nanoseconds and a characteristic impedance of 100 ohms, in the same structure as that shown in FIG. 11, in order to conduct experiments thereon.

It was found that, by increasing the dimension D to be about 5% greater than the dimension B, in relation with the width W, the rise time of the output amplitude V is improved by about 5%, and the signal rose to about 100% of the output amplitude very quickly, as shown by the solid line in FIG. 12 which was mentioned previously.

Thus, the electromagnetic delay line thus prepared is a super high speed type having the rise time of the output pulse signal of 200 picoseconds, and the slopes of the rises were identical and therefore it was proved that the wave form is improved by the present invention.

On the other hand, when the value of B is made to be equal to D along the widthwise direction of the bobbin 53, if the number of turns of the electroconductive strip 21 is equal to or greater than 30, the rise wave form of the output pulse signal rose to a level which is slightly lower than the 100% level as shown by the broken line in FIG. 12, and thereafter it tends to gradually reach the 100% level. This tendency became more pronounced when the delay time was increased by increasing the turns of the electroconductive strip 21, and it was not desirable.

In the electromagnetic delay line of this third preferred embodiment, the ground plane 51 may not only be placed nearer to the bends 55 of the electroconductive strip 21, but may also be located nearer to the side of the ends 23 of the individual electroconductive strip 19, so as to make D smaller than B. Further, the ratio of the dimensions B and D with respect to the width W of the bobbin 53, or how closely the ground plane 51 is located to one of the sides, should be determined depending upon the structure of the electromagnetic delay line and the desired properties.

Figure 15:
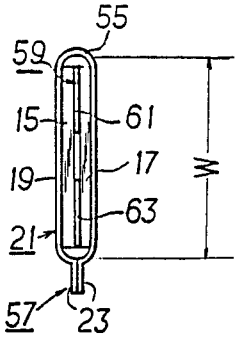
FIG. 15 is a side view showing a modification of the third preferred embodiment of the electromagnetic delay line of FIG. 11.
Figure 16:
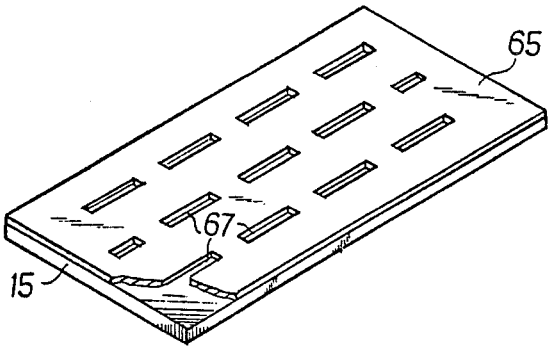
FIG. 16 is a perspective view showing an essential portion of another modification of the third preferred embodiment of the electromagnetic delay line of FIG. 11.
Figure 17:
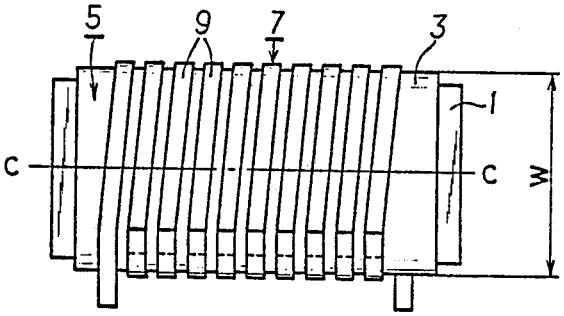
RELATED ART FIG. 17
FIGS. 17 and 18 are a front view and a side view showing an electromagnetic delay line which is related to the electromagnetic delay line of this invention.
Figure 18:
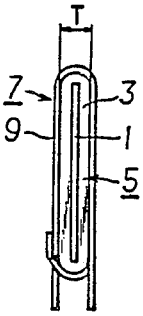
RELATED ART FIG. 18

As shown in FIG. 15, in an electromagnetic delay line similar to the first preferred embodiment, it is possible to place a pair of ground planes 61 and 63 in a mutually spaced manner along the lengthwise direction, except for the widthwise middle portion of the bobbin 59. The electromagnetic delay line of this structure tends to increase in preshoot to a certain extent, but it was found that this electromagnetic delay line can also accomplish the above mentioned object. It should be noted that the ground plane may acceptably be split into two portions, but it is not desirable to split it into fine pieces.

In the above described preferred embodiments, for the purpose of adjusting the characteristic impedance, in particular increasing the characteristic impedance, of the electroconductive strip 21, it is possible to form a number of fine slits 67 in the ground plane 65 which is laid over the first and second dielectric plates 15 and 17, so as to reach the first and second dielectric plates. The slits 67 have a different effect from that of the distance D shown in FIG. 11.

In the above described preferred embodiments of this invention, the examples were limited to the case in which the electroconductive strip 21 is formed by connecting a plurality of individual electroconductive strips 19 in series to form a single layer solenoid, but the electroconductive strip of this invention may also be formed by turning a single strip over the first and the second imaginary planes U and V in an alternating manner into a single layer solenoid, in a spaced manner. However, according to the second preferred embodiment, outstanding effect seems to have been obtained because the electroconductive strip 21 is comprised of a plurality of individual electroconductive strips 19.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular preferred embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. A distributed constant type electromagnetic delay line comprising:

(a) an elongated bobbin comprising, laminated together:

(a1) a first substantially rectangular dielectric layer;

(a2) a second substantially rectangular dielectric layer; and (a3) a substantially rectangular ground plane sandwiched between said first and second dielectric layers; and:

(b) an electroconductive strip, constituted by a single layer solenoid fixedly secured to said bobbin and wound in a spaced manner around the outer surface of said bobbin confronting said ground plane.

2. A distributed constant type electromagnetic delay line according to claim 1, wherein said electroconductive strip comprises a plurality of individual electroconductive strips, each having a length which is slightly longer than the winding length required for one turn around said bobbin, and each being fixedly secured to said bobbin generally parallel to the others of said strips, with the ends of each individual strip being offset from one another by approximately one pitch and each being connected to an end of a neighboring strip, except for end ones of said ends; said individual electroconductive strips being thus connected in series with one another.

3. A distributed constant type electromagnetic delay line according to claim 2, wherein said electroconductive strip is fixedly secured to both said first and said second dielectric layer.

4. A distributed constant type electromagnetic delay line according to claim 2, wherein said electroconductive strip is fixedly secured to one of said first and said second dielectric layer, and is separated from the other of said first and said second dielectric layer by a certain gap.

5. A distributed constant type electromagnetic delay line according to claim 3, wherein the width of said ground plane is less than the widths of said first and second dielectric layers.

6. A distributed constant type electromagnetic delay line according to claim 5, in which said ground plane is arranged opposite from the ends of said individual strips.

7. A distributed constant type electromagnetic delay line according to claim 5, in which said ground plane is arranged towards the ends of said individual strips.

8. A distributed constant type electromagnetic delay line according to claim 4, wherein the width of said ground plane is less than the widths of said first and second dielectric layers.

9. A distributed constant type electromagnetic delay line according to claim 8, in which said ground plane is arranged opposite from the ends of said individual strips.

10. A distributed constant type electromagnetic delay line according to claim 8, in which said ground plane is arranged towards the ends of said individual strips.

11. A distributed constant type electromagnetic delay line according to claim 3, wherein said ground plane is split into a plurality of portions extending along the lengthwise direction of said bobbin.

12. A distributed constant type electromagnetic delay line according to claim 4, wherein said ground plane is split into a plurality of portions extending along the lengthwise direction of said bobbin.

13. A distributed constant type electromagnetic delay line according to claim 3, wherein said ground plane is formed with a plurality of slits therein.

14. A distributed constant type electromagnetic delay line according to claim 4, wherein said ground plane is formed with a plurality of slits therein.

15. A distributed constant type electromagnetic delay line according to claim 1, wherein said elongated bobbin is a plate-shape bobbin.

16. A distributed constant type electromagnetic delay line according to claim 15, wherein said electroconductive strip adheres to at least one side of said plate-shape bobbin.

17. A distributed constant type electromagnetic delay line according to claim 15, wherein said electroconductive strip adheres to at least both sides of said plate-shape bobbin.

18. A distributed constant type electromagnetic delay line, comprising:

(a) an elongated bobbin which comprises, laminated together:

(a1) a substantially rectangular dielectric layer; and (a2) a substantially rectangular ground plane; and (b) an electroconductive strip, which comprises a single layer solenoid fixedly secured to said bobbin on its outer surface, wherein said electroconductive strip has an overlaid portion having ends, and wherein said ends of neighboring individual electroconductive strips project sideways from said bobbin and are laid over one another for soldering together and for connecting said individual electroconductive strips in series.

19. A distributed constant type electromagnetic delay line according to claim 18, wherein said electroconductive strip comprises a plurality of individual electroconductive strips, wound in a spaced manner and each having a length which is slightly longer than the winding length required for one turn around said bobbin, and each being fixedly secured to said bobbin generally parallel to the others of said strips, with the ends of each individual strip being offset from one another by approximately one pitch and each being connected to an end of a neighboring strip, except for end ones of said ends; said individual electroconductive strips being thus connected in series with one another.

* * * * *